US007886877B2

(12) United States Patent
Ueda

(10) Patent No.: US 7,886,877 B2
(45) Date of Patent: Feb. 15, 2011

(54) DOOR DEVICE FOR ELEVATOR

(75) Inventor: Takaharu Ueda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 656 days.

(21) Appl. No.: 11/993,224

(22) PCT Filed: Feb. 3, 2006

(86) PCT No.: PCT/JP2006/301854

§ 371 (c)(1),
(2), (4) Date: Dec. 20, 2007

(87) PCT Pub. No.: WO2007/088632

PCT Pub. Date: Aug. 9, 2007

(65) Prior Publication Data

US 2010/0059318 A1 Mar. 11, 2010

(51) Int. Cl.
*B66B 13/14* (2006.01)

(52) U.S. Cl. ..... 187/316; 187/391

(58) Field of Classification Search ..... 187/247, 187/248, 316, 317, 290, 293, 296, 297, 391, 187/393; 318/54–60, 65, 66, 256–258, 261, 318/264, 280, 282, 466–470; 49/26–28
See application file for complete search history.

(56) References Cited

U.S. PATENT DOCUMENTS 3,556,257 A * 1/1971 Caputo et al. ..... 187/319
4,300,662 A * 11/1981 Hmelovsky ..... 187/316
4,776,433 A * 10/1988 Lagree et al. ..... 187/316
5,864,104 A 1/1999 Tawada et al.
7,644,808 B2 * 1/2010 Yoshikawa ..... 187/316
7,729,806 B2 * 6/2010 Ohira ..... 700/275
2009/0277724 A1 * 11/2009 Thumm et al. ..... 187/393

FOREIGN PATENT DOCUMENTS

JP 5 338971 12/1993
JP 5338971 12/1993
JP 2504275 4/1996
JP 2005 104678 4/2005

* cited by examiner

*Primary Examiner*—Jonathan Salata
(74) *Attorney, Agent, or Firm*—Oblon, Spivak, McClelland, Maier & Neustadt, L.L.P.

(57) ABSTRACT

A car door is displaced with respect to a landing door between an engagement position at which the car door is engaged with the landing door and an open-away position located on a door-closing side with respect to the engagement position. While remaining engaged with the car door, the landing door is moved to open/close a landing doorway. When the landing doorway is fully closed by the landing door, a locking device performs an operation corresponding to the position of the car door with respect to the landing door to lock/unlock the landing door. A door control device has an engagement completion time calculating portion, a speed pattern generating portion, and a speed control portion. The engagement completion time calculating portion predicts an engagement completion time to a moment when the car door reaches the engagement position during a door-opening operation, based on information from an unlock detecting device for detecting whether or not the landing door has been unlocked. The speed pattern generating portion generates a speed pattern of the car door during the door-opening operation, based on information from the engagement completion time calculating portion. The speed control portion controls the speed of the car door according to the speed pattern.

5 Claims, 10 Drawing Sheets

FIG. 11

| NUMBER OF ELEVATORS | NUMBER OF FLOORS | NOMINAL CAPACITY [PERSONS] | SPEED [m/s] |
|---|---|---|---|
| 3 | 25 | 24 | 4 |
| TIME FOR OPENING/CLOSING CAR DOOR [s] | | | |
| 5 | | | |

FIG. 12

| SHORTENED TIME [s] | WAITING TIME [s] | IMPROVEMENT RATE [%] |
|---|---|---|
| 0 | 41.6 | 0.0 |
| 0.5 | 40.2 | 3.4 |
| 1 | 38.9 | 6.5 |
| 1.5 | 37.5 | 9.9 |

DOOR DEVICE FOR ELEVATOR

TECHNICAL FIELD

The present invention relates to a door device for an elevator which serves to open/close a doorway of the elevator while a car door and a landing door are engaged with each other.

BACKGROUND ART

Conventionally, there is proposed a control apparatus for an elevator door which controls the opening/closing speed of the elevator door in accordance with an engagement position and a disengagement position of a car door and a landing door which are stored in a memory for each of floors. In opening the elevator door, the engagement position at a corresponding one of the floors is read from the memory, and a position for increasing the moving speed of the car door is calculated based on the read engagement position. In closing the elevator door, the disengagement position at a corresponding one of the floors is read from the memory, and a position for reducing the moving speed of the car door is calculated based on the read disengagement position (see Patent Document 1).

Patent Document 1: JP 05-338971 A

DISCLOSURE OF THE INVENTION

Problems to be Solved by the Invention

However, the engagement position where the car door is engaged with the landing door constantly changes in accordance with the accuracy with which an elevator is installed, the positions within a car where passengers stand, and the like, so the engagement position stored in advance for each of the floors does not always coincide with an actual engagement position. In the conventional control apparatus for the elevator door, therefore, in opening the elevator door, the speed of the car door may be increased before the car door reaches the engagement position or may not be increased even after the car door has passed the engagement position. In the case where the speed of the car door is increased before the car door reaches the engagement position, a loud collision noise is made when the car door is engaged with the landing door. In the case where the speed of the car door is not increased even after the car door has passed the engagement position, the time for the operation of opening the elevator door is extended. Further, in closing the elevator door as well, problems arise such as an increase in the collision noise of the landing door and an extension of the time for the operation of closing the elevator door.

The present invention has been made to solve the above-mentioned problems, and it is therefore an object of the present invention to provide a door device for an elevator which makes it possible to abate a noise made in opening/closing a doorway and shorten the time for the operation of opening/closing the doorway.

Means for Solving the Problem

A door device for an elevator according to the present invention includes: an elevator door having a landing door, and a car door displaceable with respect to the landing door between an engagement position at which the car door is engaged with the landing door and an open-away position located on a door-closing side with respect to the engagement position, the landing door and the car door being moved while being engaged with each other when the car door is located at the engagement position so that the landing door opens/closes a landing doorway; a locking device for performing an operation corresponding to a position of the car door with respect to the landing door when the landing doorway is fully closed by the landing door, locking the landing door while the car door is displaced from the engagement position to the open-away position, and unlocking the landing door while the car door is displaced from the open-away position to the engagement position; an unlock detecting device for detecting whether or not the landing door is unlocked; a door control device having an engagement completion time calculating portion for predicting an engagement completion time to a moment when the car door reaches the engagement position during a door-opening operation based on information from the unlock detecting device, a speed pattern generating portion for generating a speed pattern of the car door during the door-closing operation based on information from the engagement completion time calculating portion, and a speed control portion for controlling a speed of the car door according to the speed pattern.

BRIEF DESCRIPTION OF THE DRAWINGS

FIG. 11 is a chart showing the specifications of elevators subjected to this simulation.

FIG. 12 is a chart showing the waiting time (second) and the improvement rate (%) of waiting time when the time for the operation of opening/closing each car door of FIG. 11 is shortened by 0.5 seconds each time.

BEST MODE FOR CARRYING OUT THE INVENTION

A preferred embodiment of the present invention will be described hereinafter with reference to the drawings.

Embodiment 1

Figure 1:
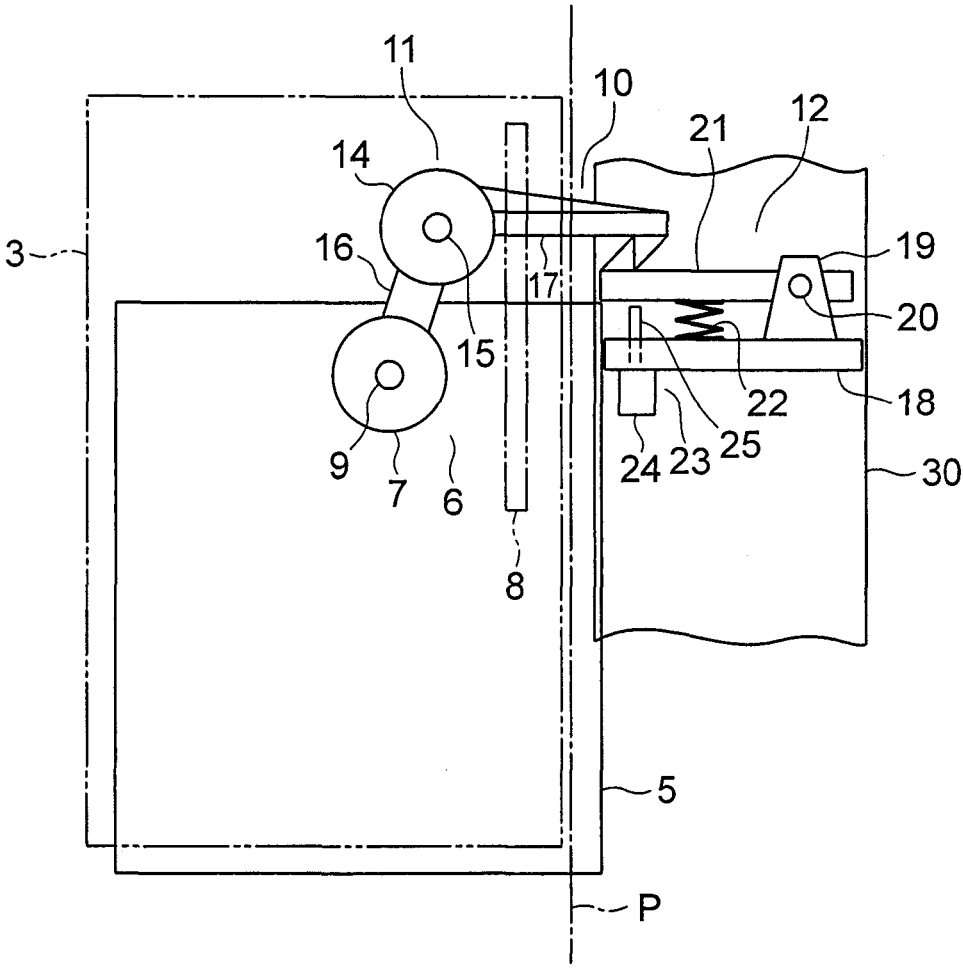
FIG. 1 is a partial front view showing a door device for an elevator according to Embodiment 1 of the present invention.
Figure 2:
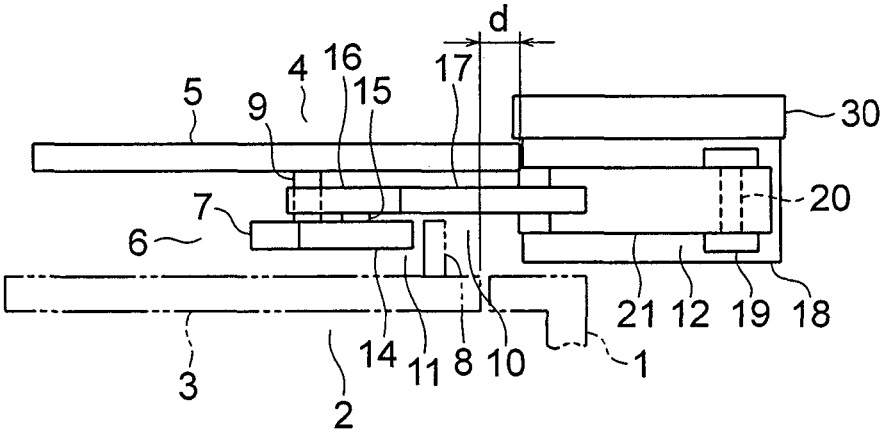
FIG. 2 is a plan view showing the door device for the elevator shown in FIG. 1.
Figure 3:
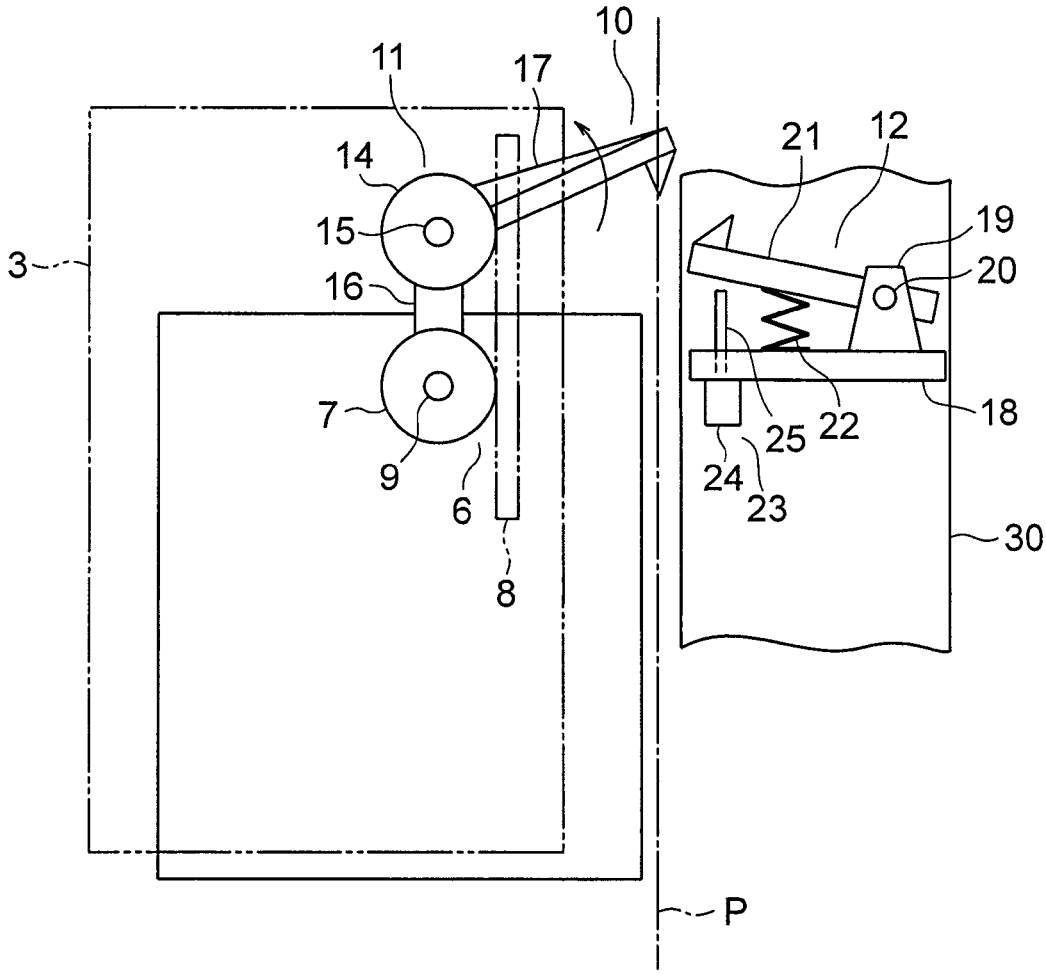
FIG. 3 is a partial front view showing the door device for the elevator when a car doorway and a landing doorway of FIG. 1 are half open.
Figure 4:
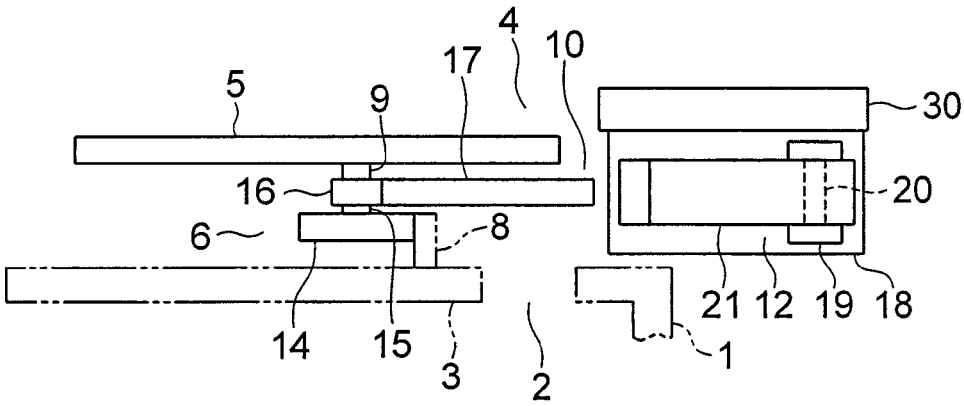
FIG. 4 is a plan view showing the door device for the elevator shown in FIG. 3.

FIG. 1 is a partial front view showing a door device for an elevator according to Embodiment 1 of the present invention. FIG. 2 is a plan view showing the door device for the elevator shown in FIG. 1. FIG. 3 is a partial front view showing the door device for the elevator when a car doorway and a landing doorway of FIG. 1 are half open. FIG. 4 is a plan view showing the door device for the elevator shown in FIG. 3. The door device for the elevator shown in FIGS. 1 to 4 is a single swing-type door device. Referring to FIGS. 1 to 4, a car 1 that is raised/lowered within a hoistway is provided with a car doorway 2. A car-side door rail (not shown) is provided in an upper portion of the car doorway 2. A car door 3 capable of opening/closing the car doorway 2 is suspended from the car-side door rail. The car door 3 is moved in a reciprocating manner in the direction of a frontage of the car doorway 2 while being guided by the car-side door rail due to a driving force of a door driving device mounted on the car 1. Thus, the car doorway 2 is opened/closed.

A landing doorway 4 is provided at a landing of each of floors. A landing-side door rail (not shown) fixed to a wall surface on the landing side is provided in an upper portion of the landing doorway 4. A landing door 5 capable of opening/closing the landing doorway 4 is suspended from the landing-side door rail. The landing door 5 can be moved in a reciprocating manner in the direction of a frontage of the landing doorway 4 by being guided by the landing-side door rail. The landing doorway 4 is opened/closed through reciprocating movements of the landing door 5. The landing door 5 is constantly urged in such a direction as to close the landing doorway 4 (door-closing direction) by an urging device (not shown) including a weight or a spring. An elevator door has the car door 3 and the landing door 5. A doorway of the elevator is opened/closed by the elevator door. A line P shown in each of FIGS. 1 and 3 is a car door reference line indicating the position of a door-closing side end of the car door 3 when the car doorway 2 is fully closed by the car door 3.

The car door 3 and the landing door 5 are disposed apart from each other in a depth direction of the car 1 when the car 1 is stopped at each of the floors. An engagement device 6 for engaging the car door 3 and the landing door 5 with each other is provided between the car door 3 and the landing door 5. The engagement device 6 has an engagement roller 7 provided on the landing door 5, and a vane 8 fixed to the car door 3 in a manner engageable with the engagement roller 7. The engagement roller 7 is a roller rotatable around a support shaft (horizontal shaft) 9 extending in the depth direction of the car 1. The vane 8 is a plate-shaped member extending vertically. The vane 8 is disposed on the door-closing side with respect to the engagement roller 7.

When the landing doorway 4 is fully closed by the landing door 5, the car door 3 is displaceable between an engagement position at which the car door 3 is engaged with the landing door 5, and an open-away position located on the door-closing side with respect to the engagement position. When the car door 3 is located at the engagement position, the vane 8 is engaged with the engagement roller 7. The vane 8 is disengaged from the engagement roller 7 through displacement of the car door 3 from the engagement position to the open-away position.

A clearance d between the door-closing side end of the car door 3 and a door-closing side end of the landing door 5 in the direction of the frontage at the time when the car doorway 2 and the landing doorway 4 are fully closed by the car door 3 and the landing door 5, respectively, changes depending on the dispersion of the accuracy with which the elevator is installed, the dispersion of the positions where passengers stand within the car 1, and the like. That is, the open-away position of the car door 3 with respect to the landing door 5 changes depending on structural factors of the elevator.

When the landing door 5 is engaged with the car door 3, the car door 3 is moved in a door-opening direction, so the landing door 5 is moved together with the car door 3 in the door-opening direction against the urging by the urging device in the door-closing direction. When the landing door 5 is engaged with the car door 3, the car door 3 is moved in the door-closing direction, so the landing door 5 is moved in the door-closing direction in accordance with the movement of the car door 3 without being disengaged therefrom owing to the urging by the urging device in the door-closing direction.

When the landing doorway 4 is fully closed by the landing door 5, a locking device 10 can lock the landing door 5. When the landing door 5 is locked, the movement of the landing door 5 in the door-opening direction is prevented. An architectural fixed member 30 for installing the locking device 10 is fixed within the hoistway. The architectural fixed member 30 is disposed on a wall surface of the landing doorway 4 on the door-closing side.

The locking device 10 has a door-side locking body 11 provided on the landing door 5, and a landing-side locking body 12 provided on the architectural fixed member 30 to engage the door-side locking body 11 in a stopped state. The door-side locking body 11 is turnable between a lock position (FIGS. 1 and 2) at which the door-side locking body 11 is engaged with the landing-side locking body 12 in a stopped state, and an unlock position (FIGS. 3 and 4) at which the door-side locking body 11 is released from engagement with the landing-side locking body 12 in a stopped state. The landing door 5 is locked through engagement of the door-side locking body 11 with the landing-side locking body 12 in a stopped state. The landing door 5 is unlocked through the release of engagement of the door-side locking body 11 with the landing-side locking body 12 in a stopped state.

The door-side locking body 11 has a turning link 16 turnable around the support shaft 9, a door-side hook member 17 fixed to a tip of the turning link 16 and inclined with respect to the turning link 16, and a rocking roller 14 provided on the turning link 16 in a manner engageable with the vane 8. The rocking roller 14 is rotatable around a rotary shaft 15 extending parallel to the support shaft 9.

When the car door 3 is displaced with respect to the landing door 5 with the rocking roller 14 engaged with the vane 8, the door-side locking body 11 is thereby turned with respect to the landing door 5. The car door 3 is displaced with respect to the landing door 5 between the engagement position and an intermediate position located on the door-closing side from the engagement position by a predetermined distance, with the vane 8 remaining engaged with the rocking roller 14. The door-side locking body 11 is turned from the lock position to the unlock position through displacement of the car door 3 from the intermediate position to the engagement position, and from the unlock position to the lock position through displacement of the car door 3 from the engagement position to the intermediate position. The intermediate position is located between the engagement position and the open-away position.

That is, when the car door 3 is located between the engagement position and the intermediate position, the door-side locking body 11 and the car door 3 are structurally interlocked with each other. Thus, when the landing doorway 4 is fully closed by the landing door 5, the locking device 10 performs an operation corresponding to the position of the car door 3 with respect to the landing door 5. The locking device 10 locks the landing door 5 during displacement of the car door 3 from the engagement position to the open-away position, and unlocks the landing door 5 during displacement of the car door 3 from the open-away position to the engagement position.

The landing-side locking body 12 is supported by a base 18 fixed to the architectural fixed member 30. The landing-side locking body 12 has a landing-side hook member 21 turnable with respect to the base 18, and an urging spring (urging body) 22 disposed between the landing-side hook member 21 and the base 18.

The landing-side hook member 21 can turn around a turning shaft 20 provided on a support projection portion 19 of the base 18. The landing-side hook member 21 engages the door-side hook member 17 in a stopped state when the door-side locking body 11 is turned to the lock position.

The urging spring 22 urges the landing-side hook member 21 in such a direction as to act against a turning force received from the door-side hook member 17 by the landing-side hook member 21. When the landing-side hook member 21 engages the door-side hook member 17 in a stopped state, the urging spring 22 is contracted between the landing-side hook member 21 and the base 18. When engagement of the door-side hook member 17 in a stopped state is released, the landing-side hook member 21 is turned away from the base 18 due to an urging force of the urging spring 22.

The base 18 is provided with an unlock detecting device 23 for detecting whether or not the locking of the landing door 5 by the locking device 10 has been released. The unlock detecting device 23 has a detecting device body 24 fixed to the base 18, and a displacement strip 25 displaceable with respect to the detecting device body 24.

The displacement strip 25 is urged in such a direction as to press the landing-side hook member 21. The displacement strip 25 is displaced to a backward position when the landing-side hook member 21 engages the door-side hook member 17 in a stopped state, and to a forward position through the turning of the landing-side hook member 21 resulting from the release of engagement of the door-side hook member 17 in a stopped state. The detecting device body 24 detects the locking of the landing door 5 by the locking device 10 when the displacement strip 25 is located at the backward position, and the release of the locking of the landing door 5 by the locking device 10 when the displacement strip 25 is located at the forward position. Upon detecting the release of the locking, the detecting device body 24 outputs an unlock detection signal.

An operation control device 34 for controlling the operation of the elevator is installed within the hoistway. A door opening command to perform a door-opening operation of the car door 3 and a door closing command to perform a door-closing operation of the car door 3 are output from the operation control device 34.

Figure 5:
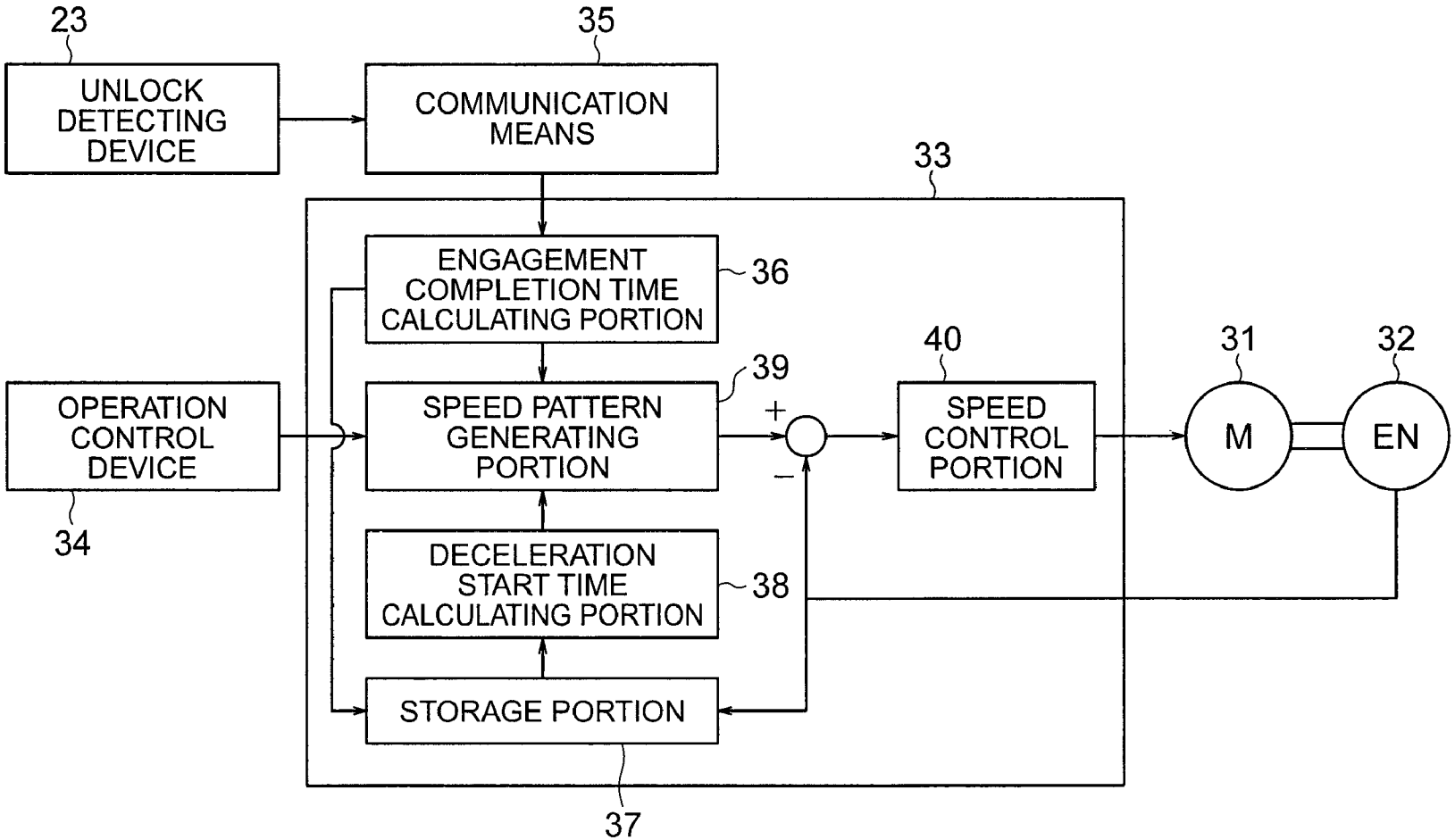
FIG. 5 is a block diagram showing a door control device for controlling the operation of opening/closing the car door of FIG. 1.

FIG. 5 is a block diagram showing a door control device for controlling the operation of opening/closing the car door 3 of FIG. 1. Referring to FIG. 5, information from the operation control device 34 and information from the unlock detecting device 23 are transmitted to a door control device 33 mounted on the car 1. The door control device 33 controls the operation of opening/closing the car door 3 based on the information from the operation control device 34 and the information from the unlock detecting device 23.

The information from the unlock detecting device 23 is transmitted to the door control device 33 via communication means 35. In this example, the communication means 35 is a dedicated communication device for establishing communication exclusively between the unlock detecting device 23 and the door control device 33. The communication means 35 is not required to be the dedicated communication device. The information from the unlock detecting device 23 may be transmitted to the door control device 33 by a communication device for another use which establishes communication among respective components provided at the landing and on the car 1. For example, the information from the unlock detecting device 23 may be transmitted to the door control device 33 by a communication device for establishing communication to display within the car 1 information on a desired stop floor set at the landing.

A door driving device for generating a driving force for moving the car door 3 has a motor 31. The rotational speed of the motor 31 is controlled by the door control device 33. The door driving device is provided with an encoder (door position detecting device) 32 for detecting the amount of rotation of the motor 31. The position of the car door 3 is calculated based on information from the encoder 32.

The door control device 33 has an engagement completion time calculating portion 36, a storage portion 37, a deceleration start time calculating portion 38, a speed pattern generating portion 39, and a speed control portion 40.

During the door-opening operation, the engagement completion time calculating portion 36 predicts an engagement completion time from a moment when the door-opening operation is started to a moment when the car door 3 reaches the engagement position, based on the information from the unlock detecting device 23. A predetermined engagement completion time (set engagement completion time) is set in advance in the engagement completion time calculating portion 36. By receiving an unlock detection signal, the engagement completion time calculating portion 36 predictively calculates an engagement completion time (calculated engagement completion time) as a reception reference. The engagement completion time as the reception reference is an engagement completion time that is predictively calculated using as a reference a moment when the unlock detection signal is received. In addition, the engagement completion time calculating portion 36 selects the shorter one of the set engagement completion time and the calculated engagement completion time as the engagement completion time.

During the door-opening operation, the storage portion 37 stores the position of the car door 3 upon the lapse of the engagement completion time, based on information from the engagement completion time calculating portion 36 and the information from the encoder 32.

The deceleration start time calculating portion 38 predicts a deceleration start time from a moment when the door-closing operation is started to a moment when the car door 3 and the landing door 5 are disengaged from each other, based on information from the storage portion 37. A predetermined disengagement time (set disengagement time) is set in advance in the deceleration start time calculating portion 38. The deceleration start time calculating portion 38 calculates a disengagement time (calculated disengagement time) as a storage data reference, based on the position of the car door 3 stored in the storage portion 37. In addition, the deceleration start time calculating portion 38 selects the longer one of the set disengagement time and the calculated disengagement time as the deceleration start time.

The speed pattern generating portion 39 receives a door-opening command from the operation control device 34 to generate a speed pattern of the car door 3 during the door-opening operation, and receives a door-closing command from the operation control device 34 to generate a speed pattern of the car door 3 during the door-closing operation. The speed pattern generating portion 39 generates the speed pattern of the car door 3 during the door-opening operation based on the information from the engagement completion time calculating portion 36. In addition, the speed pattern generating portion 39 generates the speed pattern of the car door 3 during the door-closing operation based on information from the deceleration start time calculating portion 38. In the speed pattern of the car door 3 during the door-opening operation, the speed of the car door 3 is increased upon the lapse of the engagement completion time after the start of the door-opening operation. In the speed pattern of the car door 3 during the door-closing operation, the speed of the car door 3 is reduced upon the lapse of the deceleration start time after the start of the door-closing operation.

The speed control portion 40 controls the speed of the car door 3 according to the speed pattern of the car door 3 generated by the speed pattern generating portion 39. The control of the speed of the car door 3 is performed by comparing the speed pattern generated by the speed pattern generating portion 39 with a detected speed detected by the encoder 32 and causing the detected speed to follow the speed pattern.

Figure 6:
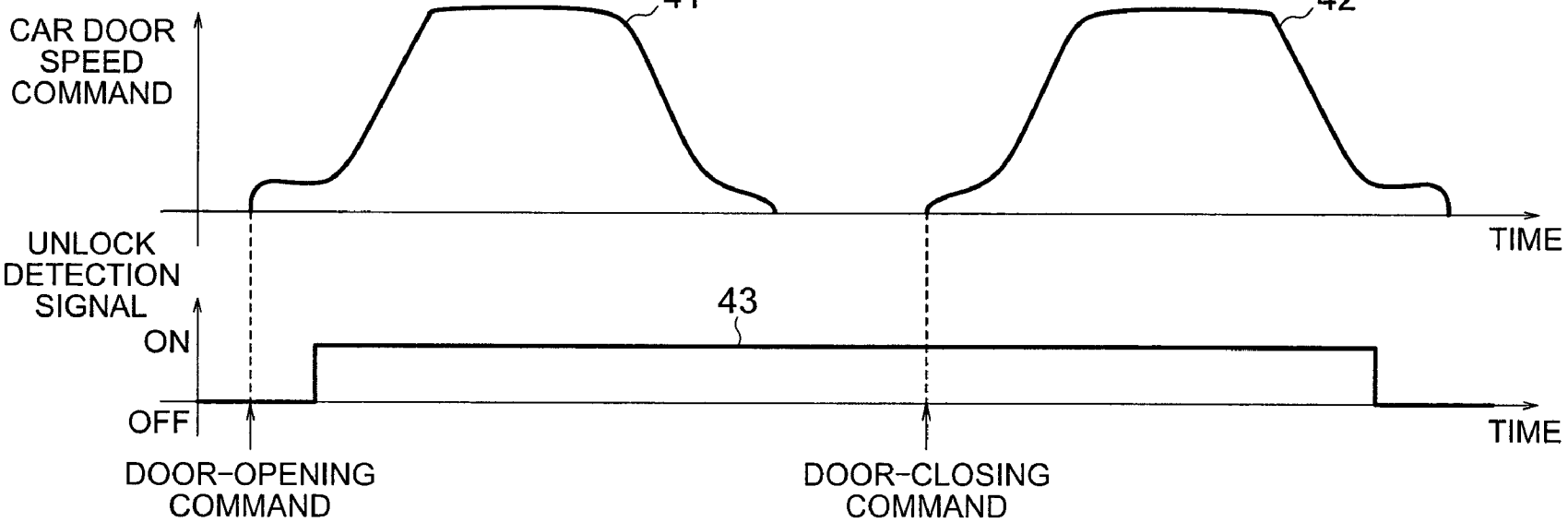
FIG. 6 is composed of graphs showing a relationship between the speed pattern generated by the speed pattern generating portion of FIG. 5 and the presence or absence of an unlock detection signal received from the unlock detecting device.

FIG. 6 is composed of graphs showing a relationship between the speed pattern generated by the speed pattern generating portion 39 of FIG. 5 and the presence or absence of an unlock detection signal received from the unlock detecting device 23. As shown in FIG. 6, a low-speed interval, an acceleration interval, a high-speed interval, and a deceleration interval are provided in a speed pattern 41 during the door-opening operation. In the low-speed interval, the speed of the car door 3 is held low after the reception of a door-opening command. In the acceleration interval following the lapse of the low-speed interval, the speed of the car door 3 is increased. In the high-speed interval following the lapse of the acceleration interval, the speed of the car door 3 is held high. In the deceleration interval following the lapse of the high-speed interval, the speed of the car door 3 is reduced.

An acceleration interval, a high-speed interval, a deceleration interval, and a low-speed interval are provided in a speed pattern 42 during the door-closing operation. In the acceleration interval, the speed of the car door 3 is increased after the reception of a door-closing command. In the high-speed interval following the lapse of the acceleration interval, the speed of the car door 3 is held high. In the deceleration interval following the lapse of the high-speed interval, the speed of the car door 3 is reduced. In the low-speed interval following the lapse of the deceleration interval, the speed of the car door 3 is held low.

In a reception pattern 43 of an unlock detection signal, reception of the unlock detection signal is started within the low-speed interval of the speed pattern 41 during the door-opening operation, and stopped within the low-speed interval of the speed pattern 42 during the door-closing operation.

Next, an operation will be described. When the car doorway 2 is fully closed by the car door 3 and the landing doorway 4 is fully closed by the landing door 5, the vane 8 is open away from each of the engagement roller 7 and the rocking roller 14 to the door-closing side (FIGS. 1 and 2).

During the door-opening operation, first of all, only the movement of the car door 3 in the door-opening direction is started. When the car door 3 is moved in the door-opening direction, the vane 8 is engaged with the rocking roller 14. After that, the car door 3 is further moved in the door-opening direction while the vane 8 and the rocking roller 14 remain engaged with each other. Thus, the door-side locking body 11 is turned from the lock position to the unlock position. Thus, engagement of the door-side locking body 11 in a stopped state by the landing-side locking body 12 is released, so the landing door 5 is unlocked.

After that, when the car door 3 is further moved in the door-opening direction and reaches the engagement position with respect to the landing door 5, the vane 8 is engaged with the engagement roller 7. After that, the car door 3 is further moved in the door-opening direction together with the landing door 5 while the vane 8 and the engagement roller 7 remain engaged with each other, so the door-opening operation is completed.

During the door-closing operation, the car door 3 is moved in the door-closing direction while remaining engaged with the landing door 5. After that, when the landing doorway 4 is fully closed by the landing door 5, only the vane 8 and the engagement roller 7 are disengaged from each other, and the car door 3 is further moved in the door-closing direction while the vane 8 and the rocking roller 14 remain engaged with each other. Thus, the door-side locking body 11 is turned from the unlock position to the lock position. Thus, the door-side locking body 11 is engaged with the landing-side locking body 12 in a stopped state, so the landing door 5 is locked. After that, the car door 3 is further moved in the door-closing direction, so the door-closing operation is completed.

Next, the processing operation of the door control device 33 will be described. The door control device 33 repeatedly performs a processing calculation at intervals of a predetermined sampling period ΔT.

Figure 7:
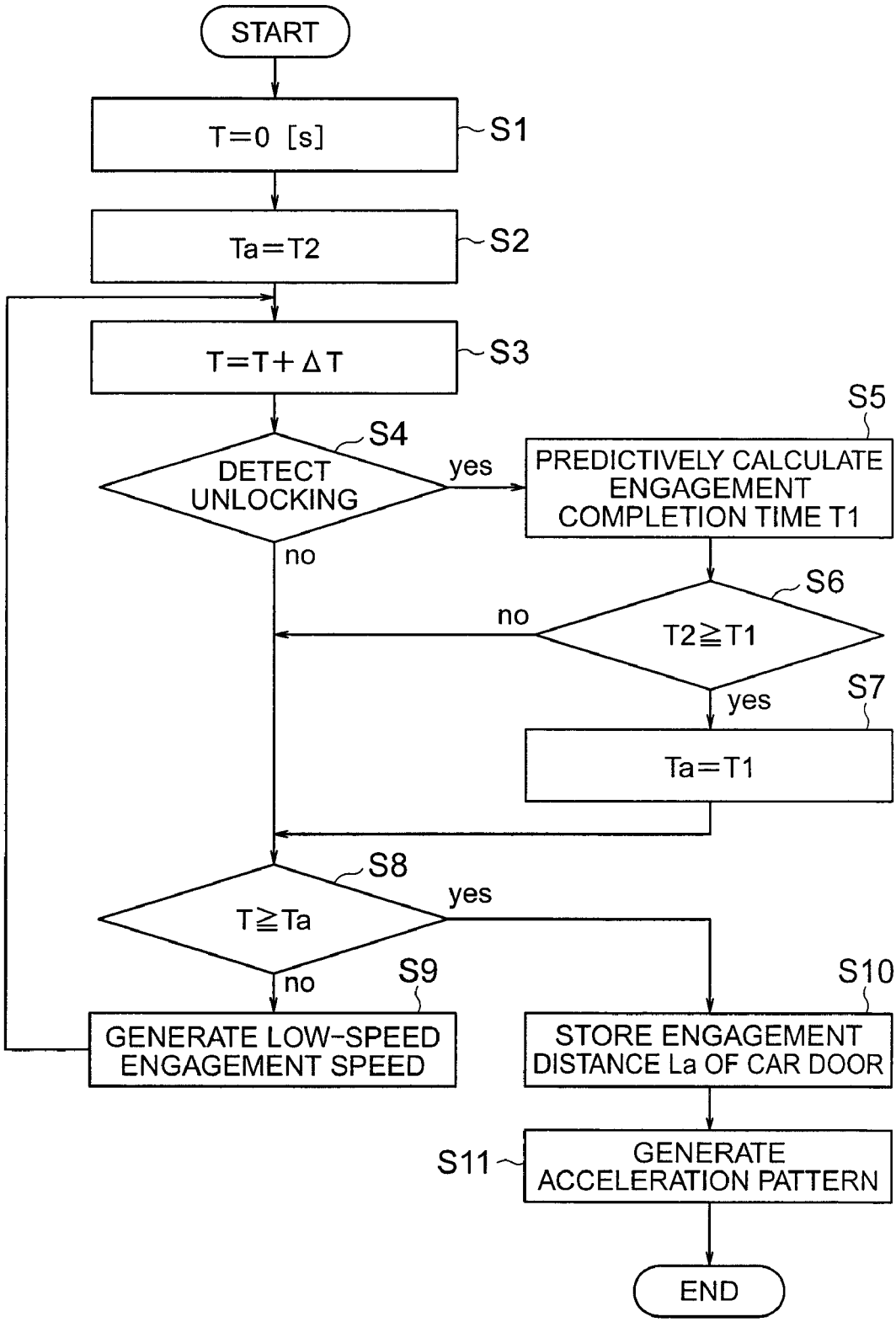
FIG. 7 is a flowchart for explaining the processing operation of the door control device of FIG. 5 during the door-opening operation.

FIG. 7 is a flowchart for explaining the processing operation of the door control device 33 of FIG. 5 during the door-opening operation. As shown in FIG. 7, upon receiving a door-opening command from the operation control device 34, the door control device 33 initializes a time counter to "0" (S1). After that, the door control device 33 sets a set engagement completion time T2 as an acceleration start time Ta (S2).

The acceleration start time Ta is a time from a moment when the door-opening operation is started to a moment when acceleration of the car door 3 is started. The set engagement completion time T2 is a predetermined time set in advance. In this example, a longest time from the moment when the door-opening operation is started to the moment when the car door 3 reaches the engagement position is set as the set engagement completion time T2. That is, the set engagement completion time T2 is calculated using an equation (1) shown below.

$$T2 = L\max / V \quad (1)$$

It should be noted that Lmax represents a maximum value of the clearance between the vane 8 and the engagement roller 7 which changes depending on, for example, the difference in the positions within the car 1 where passengers stand, the accuracy with which the elevator is installed, and the like when the car doorway 2 and the landing doorway 4 are fully closed. It should also be noted that V represents a speed of the car door 3 in the low-speed interval during the door-opening operation.

After that, the time on a program is updated. That is, the sampling period ΔT is added to a current time T that has elapsed after the start of the door-opening operation, and a time obtained through addition is set as the current time T (S3). After that, the engagement completion time calculating portion 36 determines whether or not an unlock detection signal has been received (S4).

When it is determined that the unlock detection signal has been received, the engagement completion time calculating portion 36 predictively calculates a calculated engagement completion time T1 based on the reception of the unlock detection signal (S5).

The calculated engagement completion time T1 is an engagement completion time calculated based on a time from a moment when the unlock detection signal is received to a moment when the car door 3 reaches the engagement position. In this example, the calculated engagement completion time T1 is calculated using an equation (2) shown below.

$$T1=T+L1/V-T0 \quad (2)$$

It should be noted that L1 represents an engagement reference distance by which the car door 3 is displaced with respect to the landing door 5 from a moment when the unlocking is detected to a moment when the car door 3 reaches the engagement position. That is, the engagement reference distance L1 is a distance structurally determined by a positional relationship between the car door 3 and the landing door 5. The engagement reference distance L1 is set in advance in the engagement completion time calculating portion 36. It should also be noted that T0 represents a communication delay time to a moment when the unlock detection signal is input to the engagement completion time calculating portion 36 from the unlock detecting device 23 via the communication means 35.

After that, the engagement completion time calculating portion 36 determines whether or not the calculated engagement completion time T1 is equal to or shorter than the set engagement completion time T2 (S6). When it is determined that the calculated engagement completion time T1 is equal to or shorter than the set engagement completion time T2, the calculated engagement completion time T1 is set as the acceleration start time Ta (S7).

On the other hand, when it is determined that the unlock detection signal has not been received or when it is determined that the calculated engagement completion time T1 is longer than the set engagement completion time T2, the acceleration start time Ta is held equal to the set engagement completion time T2.

After that, the engagement completion time calculating portion 36 determines whether or not the current time T is equal to or longer than the acceleration start time Ta (S8). When it is determined that the current time T is shorter than the acceleration start time Ta, the speed of the car door 3 is held low. That is, the speed pattern generating portion 39 generates a low-speed engagement speed (S9). After that, the current time T is updated (S3) to repeatedly perform the foregoing processings.

When it is determined that the current time T is equal to or longer than the acceleration start time Ta, the moving distance of the car door 3 after the start of the door-opening operation is stored into the storage portion 37 as an engagement distance La based on information from the encoder 32 (S10).

After that, the speed pattern generating portion 39 generates an acceleration pattern for increasing the speed of the car door 3 (S11).

Figure 8:
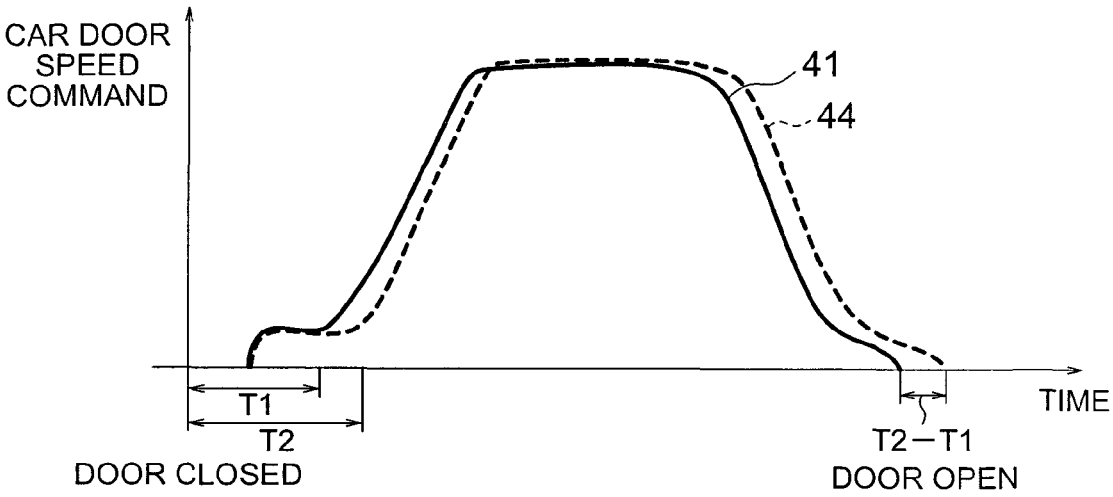
FIG. 8 is a graph showing the speed pattern during the door-opening operation which is generated by the speed pattern generating portion of FIG. 5, and a conventional speed pattern during the door-opening operation.

FIG. 8 is a graph showing the speed pattern 41 during the door-opening operation which is generated by the speed pattern generating portion 39 of FIG. 5, and a conventional speed pattern 44 during the door-opening operation. As shown in FIG. 8, the time from the moment when the door-opening operation is started to the moment when acceleration of the car door 3 is started is shorter in the speed pattern 41 generated by the speed pattern generating portion 39 than in the conventional speed pattern 44. Accordingly, the door-opening operation time from the moment when the door-opening operation is started to the moment when the door-opening operation is completed is also shorter in the case of the speed pattern 41 generated by the speed pattern generating portion 39 than in the case of the conventional speed pattern 44.

Figure 9:
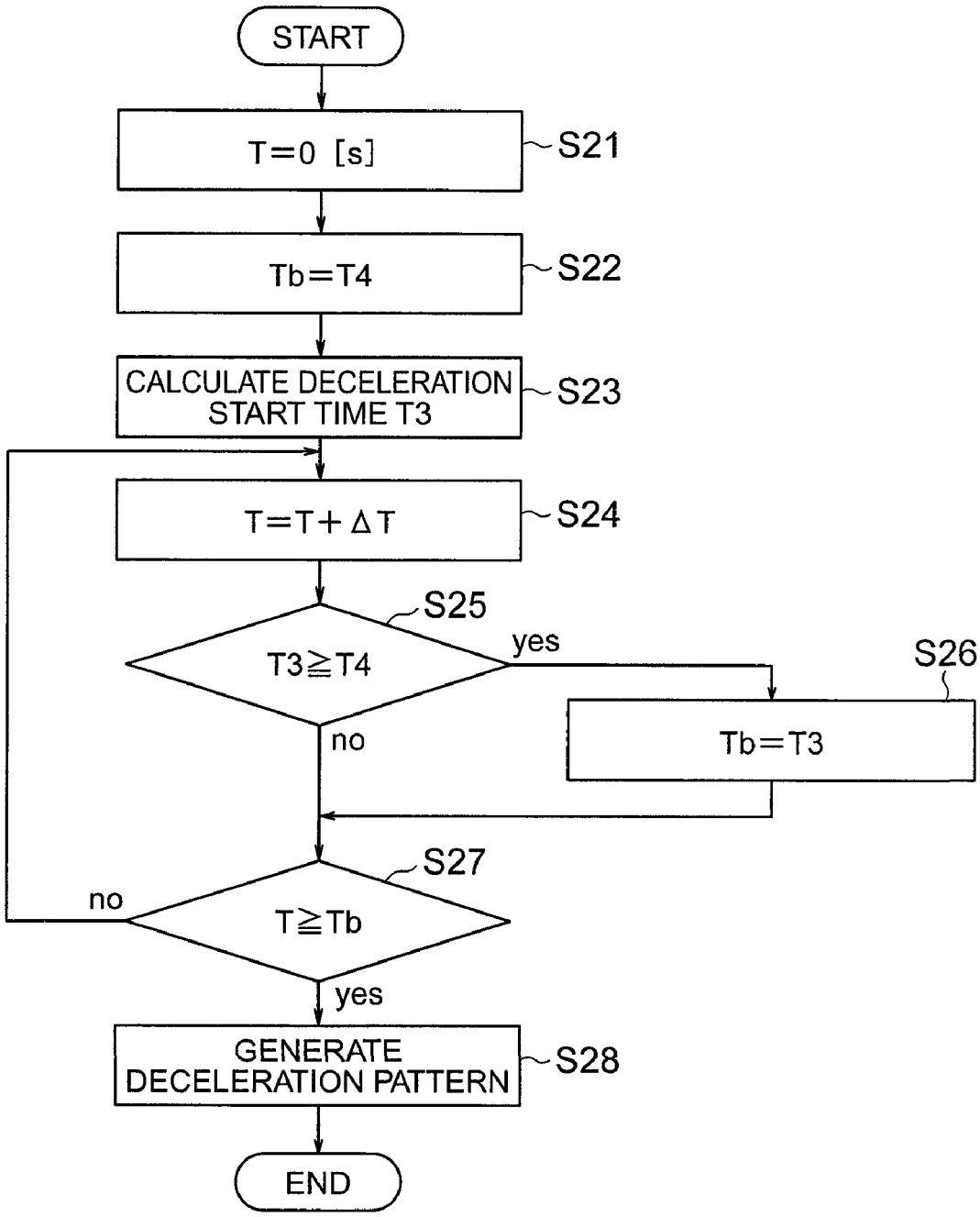
FIG. 9 is a flowchart for explaining the processing operation of the door control device of FIG. 5 during the door-closing operation.

FIG. 9 is a flowchart for explaining the processing operation of the door control device 33 of FIG. 5 during the door-closing operation. As shown in FIG. 9, upon receiving a door-closing command from the operation control device 34, the door control device 33 initializes the time counter to "0" (S21). After that, the door control device 33 sets a set disengagement time T4 as a deceleration start time Tb (S22).

The deceleration start time Tb is a time from a moment when the door-closing operation is started to a moment when deceleration of the car door 3 is started. The set disengagement time T4 is a predetermined disengagement time set in advance. In this example, a shortest time from the moment when the door-closing operation is started to the moment when the car door 3 and the landing door 5 are disengaged from each other is set as the set disengagement time T4.

After that, the deceleration start time calculating portion 38 calculates a calculated disengagement time T3 based on information stored in the storage portion 37. That is, the deceleration start time calculating portion 38 calculates a time difference ΔT3 from the set disengagement time T4 based on the information stored in the storage portion 37, and calculates the calculated disengagement time T3 based on the calculated time difference ΔT3 (S23).

The time difference ΔT3 is calculated using an equation (3) shown below.

$$\Delta T3=(L\max-La-\Delta L)/V\max \quad (4)$$

It should be noted that ΔL represents a maximum error resulting from the difference in the positions of passengers within the car 1, and that Vmax represents a maximum speed of the car door 3 during the door-closing operation.

The calculated disengagement time T3 is calculated using an equation (4) shown below.

$$T3=T4+\Delta T3 \quad (4)$$

After that, the time on the program is updated. That is, the sampling period ΔT is added to the current time T that has elapsed after the start of the door-closing operation, and a time obtained through addition is set as the current time T (S24).

After that, the deceleration start time calculating portion 38 determines whether or not the calculated disengagement time T3 is equal to or longer than the set disengagement time T4 (S25). When it is determined that the calculated disengagement time T3 is equal to or longer than the set disengagement time T4, the calculated disengagement time T3 is set as the deceleration start time Tb (S26).

When it is determined that the calculated disengagement time T3 is shorter than the set disengagement time T4, the deceleration start time Tb is held equal to the set disengagement time T4.

After that, the deceleration start time calculating portion 38 determines whether or not the current time T is equal to or longer than the deceleration start time Tb (S27). When it is determined that the current time T is shorter than the deceleration start time Tb, the current time T is updated (S24) to repeatedly perform the foregoing processings. When it is determined that the current time T is equal to or longer than the deceleration start time Tb, the speed pattern generating portion 39 generates a deceleration pattern for reducing the speed of the car door 3 (S28).

Figure 10:
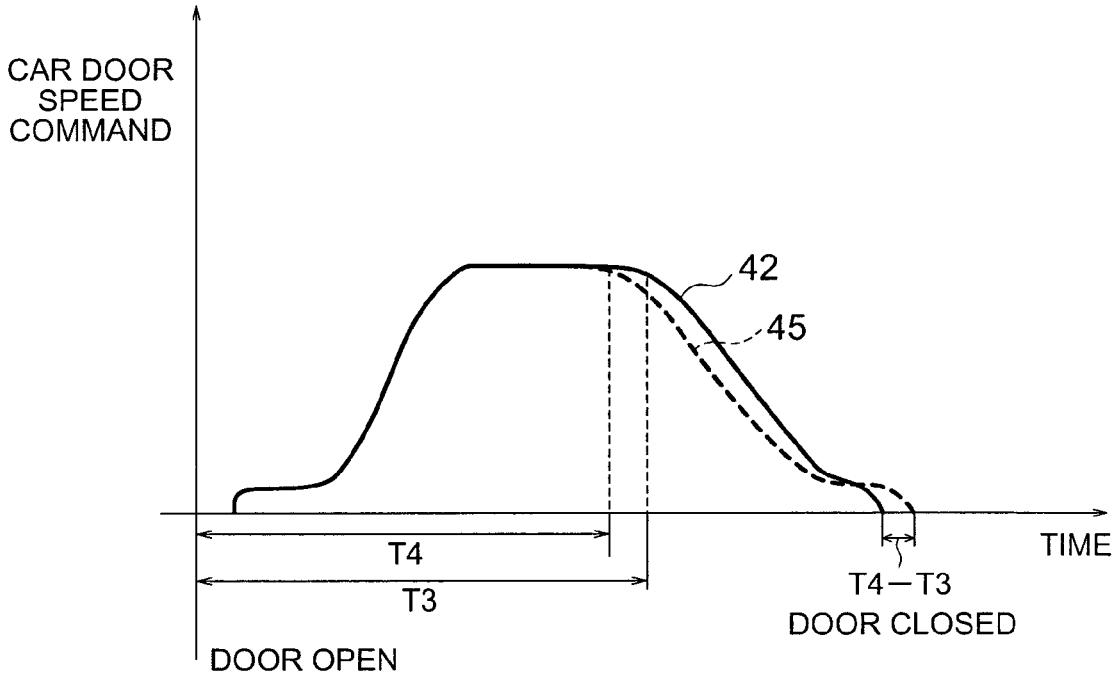
FIG. 10 is a graph showing the speed pattern during the door-closing operation which is generated by the speed pattern generating portion of FIG. 5, and a conventional speed pattern during the door-closing operation.

FIG. 10 is a graph showing the speed pattern 42 during the door-closing operation which is generated by the speed pattern generating portion 39 of FIG. 5, and a conventional speed pattern 45 during the door-closing operation. As shown in FIG. 10, the time from the moment when the door-closing operation is started to the moment when deceleration of the car door 3 is started is longer in the speed pattern 42 generated by the speed pattern generating portion 39 than in the conventional speed pattern 45. Accordingly, the time during which the car door 3 is moved at high speed can be made longer than before. Thus, the door-closing operation time from the moment when the door-closing operation is started to the moment when the door-closing operation is completed is shorter in the case of the speed pattern 42 generated by the speed pattern generating portion 39 than in the case of the conventional speed pattern 45.

In the door device for the elevator constructed as described above, the engagement completion time to the moment when the car door 3 is engaged with the landing door 5 is predicted during the door-opening operation based on the information from the unlock detecting device 23 for detecting whether or not the landing door 5 is locked, and the speed pattern of the car door 3 during the door-opening operation is generated based on the predicted engagement completion time. Therefore, the engagement completion time can be calculated regardless of the position of the car door 3 with respect to the landing door 5 at the start of the door-opening operation. Accordingly, the engagement completion time can be predicted more accurately even when the position of the car door 3 at the start of the door-opening operation deviates from the reference position. Thus, the speed of the car door 3 can be increased after the car door 3 has been engaged with the landing door 5, so the noise made at the moment when the car door 3 and the landing door 5 are engaged with each other can be abated. The time during which the car door 3 is moved at low speed while remaining engaged with the landing door 5 can be shortened, so the time for the door-opening operation can be shortened.

The engagement completion time is predicted based on the information from the unlock detecting device 23 for detecting whether or not the landing door 5 is locked, the position of the car door 3 upon the lapse of the predicted engagement completion time is stored during the door-opening operation, and the speed pattern of the car door 3 during the door-closing operation is generated based on the stored position of the car door 3. Therefore, the disengagement time from the moment when the door-closing operation is started to the moment when the car door 3 and the landing door 5 are disengaged from each other can be calculated more accurately. Thus, the landing door 5 can be prevented from fully closing the landing doorway 4 while being moved at high speed, so the noise made upon full closure of the landing doorway 4 by the landing door can be abated. The time during which the car door 3 is moved at high speed can be extended, so the time for the door-closing operation can be shortened.

A simulation has been carried out to demonstrate that the waiting time at each of the floors is also shortened by shortening the time for the operation of opening/closing the doorway of the elevator. FIG. 11 is a chart showing the specifications of elevators subjected to this simulation. As shown in FIG. 11, three elevators installed in a 25-story building are subjected to the simulation. The total nominal capacity of the respective elevators is 24 persons, and the rated speed of each car is 4 m/s (i.e., 240 m per minute). Further, a reference value of the time for the operation of opening/closing each car door is set as 5 seconds.

Figure 13:
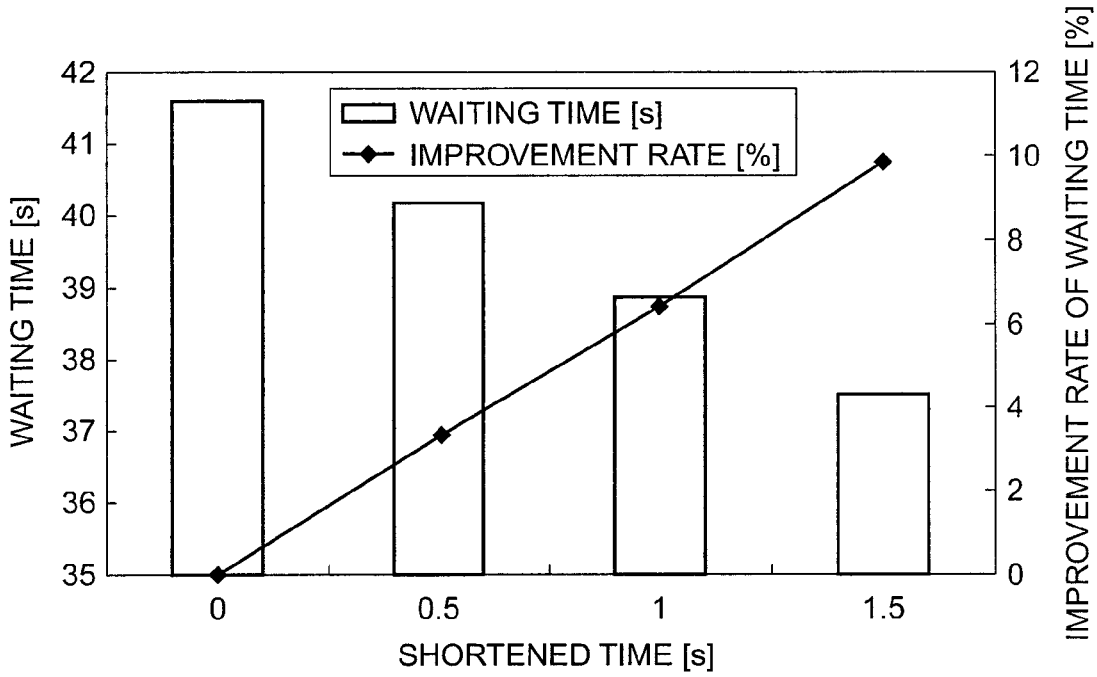
FIG. 13 is a graph showing how a shortened time of FIG. 12 is related to the waiting time and the improvement rate.

FIG. 12 is a chart showing the waiting time (second) and the improvement rate (%) of waiting time when the time for the operation of opening/closing each car door of FIG. 11 is shortened by 0.5 seconds each time. FIG. 13 is a graph showing how a shortened time of FIG. 12 is related to the waiting time and the improvement rate. As shown in FIGS. 12 and 13, it is understood that the waiting time is shortened and the improvement rate of waiting time is enhanced as the length of time by which the time for the operation of opening/closing the car door is shortened is increased.

The shorter one of the calculated engagement completion time T1 predictively calculated based on the reception of the unlock detection signal from the unlock detecting device 23 and the set engagement completion time T2 set in advance is set as the engagement completion time Ta. Therefore, the door-opening operation of the doorway of the elevator can be prevented from being hindered even when the reception of the unlock detection signal has become impossible due to, for example, a malfunction of the unlock detecting device 23.

The longer one of the calculated disengagement time T3 calculated based on the information from the storage portion 37 and the set disengagement time T4 set in advance is set as the deceleration start time Tb. Therefore, the door-closing operation of the doorway of the elevator can be prevented from being hindered even when the reception of the unlock detection signal has become impossible due to, for example, a malfunction of the unlock detecting device 23.

The information from the unlock detecting device 23 is transmitted to the door control device 33 by a part of the communication means 35 for establishing communication among the respective components provided at the landing and on the car 1. Therefore, there is no need to install a dedicated communication device. As a result, a reduction in cost can be achieved.

In the foregoing example, the present invention is applied to the single swing-type door device. However, the present invention may also be applied to a double swing-type door device.

The invention claimed is:

1. A door device for an elevator, comprising:

an elevator door having a landing door, and a car door displaceable with respect to the landing door between an engagement position at which the car door is engaged with the landing door and an open-away position located on a door-closing side with respect to the engagement position, the landing door and the car door being moved while being engaged with each other when the car door is located at the engagement position so that the landing door opens/closes a landing doorway;

a locking device for performing an operation corresponding to a position of the car door with respect to the landing door when the landing doorway is fully closed by the landing door, locking the landing door while the car door is displaced from the engagement position to the open-away position, and unlocking the landing door while the car door is displaced from the open-away position to the engagement position;

an unlock detecting device for detecting whether or not the landing door is unlocked;

a door control device having an engagement completion time calculating portion for predicting an engagement completion time to a moment when the car door reaches the engagement position during a door-opening operation based on information from the unlock detecting device, a speed pattern generating portion for generating a speed pattern of the car door during the door-closing operation based on information from the engagement completion time calculating portion, and a speed control portion for controlling a speed of the car door according to the speed pattern.

2. A door device for an elevator, comprising:

an elevator door having a landing door, and a car door displaceable with respect to the landing door between an engagement position at which the car door is engaged with the landing door and an open-away position located on a door-closing side with respect to the engagement position, the landing door and the car door being moved while being engaged with each other when the car door is located at the engagement position so that the landing door opens/closes a landing doorway;

a locking device for performing an operation corresponding to a position of the car door with respect to the landing door when the landing doorway is fully closed by the landing door, locking the landing door while the car door is displaced from the engagement position to the open-away position, and unlocking the landing door while the car door is displaced from the open-away position to the engagement position;

an unlock detecting device for detecting whether or not the landing door is unlocked;

a door position detecting device for detecting a position of the car door; and a door control device having an engagement completion time calculating portion for predicting an engagement completion time to a moment when the car door reaches the engagement position during a door-opening operation based on information from the unlock detecting device, a storage portion for storing a position of the car door upon a lapse of the engagement completion time based on information from the engagement completion time calculating portion and information from the door position detecting device, a deceleration start time calculating portion for predicting a deceleration start time from a moment when a door-closing operation is started to a moment when the car door and the landing door are disengaged from each other based on information from the storage portion, a speed pattern generating portion for generating a speed pattern of the car door during the door-closing operation based on information from the deceleration start time calculating portion, and a speed control portion for controlling a speed of the car door according to the speed pattern.

3. A door device for an elevator according to claim 1, wherein the engagement completion time calculating portion sets as the engagement completion time a shorter one of a calculated engagement completion time calculated predictively based on detection of unlocking of the landing door and a set engagement completion time set in advance.

4. A door device for an elevator according to claim 2, wherein the deceleration start time calculating portion sets as the deceleration start time a longer one of a calculated engagement unlock time calculated based on information from the storage portion and a set engagement unlock time set in advance.

5. A door device for an elevator according to claim 1 or 2, wherein the information from the unlock detecting device is transmitted to the door control device by part of communication means for establishing communication among respective components provided at a landing and on a car.

* * * * *